US007145159B2

(12) United States Patent
Bobrov et al.

(10) Patent No.: US 7,145,159 B2
(45) Date of Patent: Dec. 5, 2006

(54) OPTICAL PROJECTION OF A THERMAL TARGET

(75) Inventors: Saar Bobrov, Manof (IL); Shmuel Oscar, Kiryat Ata (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 241 days.

(21) Appl. No.: 10/915,480

(22) Filed: Aug. 11, 2004

(65) Prior Publication Data

US 2005/0035309 A1 Feb. 17, 2005

(30) Foreign Application Priority Data

Aug. 11, 2003 (IL) ..... 157339

(51) Int. Cl.
*H05B 3/26* (2006.01)

(52) U.S. Cl. ..... 250/504 R; 250/495.1; 250/493.1

(58) Field of Classification Search ..... 250/504 R, 250/495.1, 493.1, 370.08; 359/291; 348/181
See application file for complete search history.

(56) References Cited

U.S. PATENT DOCUMENTS 4,605,232 A 8/1986 Hundstad
5,576,553 A * 11/1996 Adachi ..... 250/495.1
5,596,185 A 1/1997 Bross et al.

FOREIGN PATENT DOCUMENTS

DE 19914664 10/2000
EP 0250178 12/1987

* cited by examiner

*Primary Examiner*—Kiel T. Nguyen
(74) *Attorney, Agent, or Firm*—Mark M. Friedman

(57) ABSTRACT

A method for generating a thermal target. The method includes generating hot-body thermal radiation from a heated source, the thermal radiation emanating from a projection region with a first maximum dimension, and employing an optical arrangement to project at least part of the thermal radiation onto a target region of a surface, the target region with a second maximum dimension greater than the first maximum dimension.

26 Claims, 1 Drawing Sheet

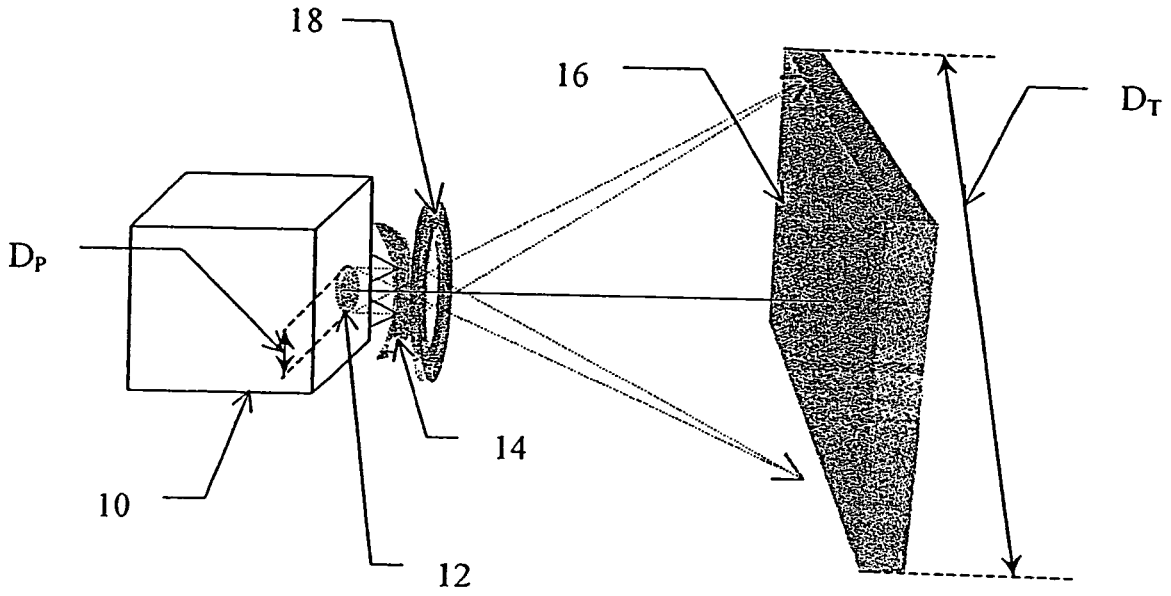
18
16
$D_T$
$D_P$
14
10
12

OPTICAL PROJECTION OF A THERMAL TARGET

FIELD AND BACKGROUND OF THE INVENTION

The present invention relates to thermal target simulation, in particular, it concerns generation of a thermal image by optical projection onto a surface.

Many systems, particularly weapon systems, operate by sensing, recognizing, analyzing, tracking, and/or homing in on a pattern of infrared ("IR") radiation generated by a body at a raised temperature, or having a predefined temperature distribution. Such systems must be tested on thermal targets which simulate a range of intended operating conditions for the system.

The conventional approach for generating a thermal target is to employ a sheet or block of thermally conductive material of the required size and shape fitted with one or more heaters and having a thermostatic controller. Generally, the exposed surface area of the device renders it difficult to control the temperature of the body precisely, particularly under adverse environmental conditions such as exposure to wind or rain. Where a large target size is used, it can become particularly difficult to ensure high thermal stability and uniformity. Thermal target simulating devices are expensive to produce, and must be customized for each size and shape of target required. The costs of such devices is particularly problematic when performing weapon system tests wherein the target itself is destroyed during testing. In many cases, adjustment of the target temperature is also be very time consuming, taking as much as several hours to heat a target thoroughly, and even longer to allow cooling to a lower temperature.

For small targets, commercially available devices known as "extended blackbodies" provide a partial solution. These devices have an enclosed cavity with specially arranged and treated surfaces maintained at a constant temperature so as to generate an approximation to ideal "blackbody radiation" at an aperture. These extended blackbodies are readily controllable and offer a high stability and uniformity. Nevertheless, since the output aperture is much smaller than the dimensions of the device, currently available blackbody devices are limited to maximum target diameters of about 0.3 m. For extended (large) targets of dimensions over 0.5 m blackbody devices are not a feasible option.

For laboratory experiments, blackbody devices are sometimes combined with optical components such as collimators and patterned apertures for testing sensor properties. Such optical systems typically require that the optical components occupy the entire field of view of the sensor, and are therefore only feasible for controlled laboratory testing. Furthermore, even if used in the field, these optical systems are highly directional such that only a single sensor can typically view the target at a time. The optical components are also typically bulky and interfere with superposition of the target on a natural background.

Also known are controllable infrared display devices which can generate a dynamic display where individual pixels generate infrared under control of a processor system. Such devices are very costly, and still do not provide a viable solution for presenting a large target against a natural background.

There is therefore a need for a system and method for generating extended thermal targets which can be used to provide different sizes and/or shapes of target against a natural background. It would also be advantageous to provide a system and method for generating extended thermal targets which would provide rapid adjustability while ensuring high temperature resolution, high uniformity and high stability.

SUMMARY OF THE INVENTION

The present invention is a thermal target projection system and corresponding method for generating a thermal target.

According to the teachings of the present invention there is provided, a method for generating a thermal target comprising: (a) generating hot-body thermal radiation from a heated source, the thermal radiation emanating from a projection region having a first maximum dimension; and (b) employing an optical arrangement to project at least part of the thermal radiation onto a target region of a surface, the target region having a second maximum dimension greater than the first maximum dimension.

There is also provided according to a further feature of the present invention, a thermal target projection system comprising: (a) a heated source for generating hot-body thermal radiation, the thermal radiation emanating from a projection region having a first maximum dimension; (b) a surface; and (c) an optical arrangement deployed to project at least part of the thermal radiation onto a target region of the surface, the target region having a second maximum dimension greater than the first maximum dimension.

According to a further feature of the present invention, the heated source is a blackbody device.

According to a further feature of the present invention, the optical arrangement includes a variable aperture, the method further comprising adjusting the variable aperture so as to vary an apparent temperature of the projected target.

According to a further feature of the present invention, the optical arrangement includes a mask for defining a shape of the target region onto which the thermal radiation is projected.

According to a further feature of the present invention, the target region includes the entirety of the surface.

According to a further feature of the present invention, the optical arrangement directs the thermal radiation over a range of directions extending beyond the surface.

According to a further feature of the present invention, the surface has an emissivity of less than 0.2, and in certain preferred cases, less than 0.1.

According to a further feature of the present invention, the surface provides a scattering effect for the thermal radiation.

According to a further feature of the present invention, the surface is formed by a coating containing particles of material having emissivity less than 0.2.

According to a further feature of the present invention, the surface is formed by a coating containing particles of aluminum.

According to a further feature of the present invention, the second maximum dimension is at least half a meter.

According to a further feature of the present invention, the first maximum dimension is no more than 30 centimeters.

There is also provided according to a further feature of the present invention, a method for generating a thermal target comprising: (a) providing a source of electromagnetic radiation having a wavelength in the range from 3 microns to 14 microns; (b) employing an optical arrangement to project at least part of the electromagnetic radiation onto a target region of a surface; and (c) adjusting at least one of the source and the optical arrangement so as to achieve a predefined temperature difference between at least part of the target region and a background region as measured by a given radiant heat sensor.

BRIEF DESCRIPTION OF THE DRAWINGS

The invention is herein described, by way of example only, with reference to the accompanying drawings, wherein the sole FIGURE is a schematic representation of a thermal target projection system, constructed and operative according to the teachings of the present invention, for generating a thermal target.

DESCRIPTION OF THE PREFERRED EMBODIMENTS

The present invention is a thermal target projection system and corresponding method for generating a thermal target.

The principles and operation of systems and methods according to the present invention may be better understood with reference to the drawings and the accompanying description.

Referring now to the drawings, the Figure shows a thermal target projection system, constructed and operative according to the teachings of the present invention, for generating a thermal target. Generally speaking, the system includes a heated source 10 for generating hot-body thermal radiation from a projection region 12. Heated source 10 may be any stable source of thermal infrared radiation (i.e., primarily in the wavelength ranges of 3–5 μm and/or 8–14 μm). Most preferably, heated source 10 is a black-body type radiation generating device which gives out thermal radiation from an aperture which defines projection region 12. Other options for source 10 will be discussed further below.

It is a particular feature of the system of the present invention that it includes an optical arrangement 14 deployed to project at least part of the thermal radiation from region 12 onto a target region of a surface 16. Optical arrangement 14 is configured to spread the thermal radiation so that the target region has a maximum dimension $D_T$ greater than the maximum dimension of projection region $D_P$.

It will readily be appreciated that projection of a thermal target provides major advantages over the heated-body targets of the prior art. Firstly, the use of optical arrangement 14 allows for generation of a thermal target of substantially any required size by use of a single heated source 10. Secondly, the thermal target can be projected on a wide range of surfaces, rendering the system cost effective even for cases where testing is destructive of the target. Thirdly, the use of a projected thermal target from a stable radiation source typically avoids the need for precise control of the actual body temperature of the body on which the target is projected, thereby allowing more rapid adjustment of the effective target temperature, and facilitating improved resolution, uniformity and stability of the temperature control. These and other advantages of the present invention will become clearer from the following description.

Turning now to the features of the thermal image projection system in more detail, as mentioned above, heated source 10 may be any stable source of thermal infrared radiation (i.e., primarily in the wavelength ranges of 3–5 μm and/or 8–14 μm). In a first basic implementation, heated source 10 is a simple heated body in which case "region 12" is typically the entire surface of the body which faces in the direction of target projection. According to a further option, heated source 10 is implemented as one or more heating element (bar or coil etc.), typically in combination with an arrangement of reflectors to distribute the radiation approximately evenly. According to yet a further option, the heated source 10 can be replaced by an infrared laser of suitable wavelength. Most preferably, heated source 10 is implemented as a blackbody device, which combines relatively low cost with high controllability, uniformity and stability. For each implementation of source 10, appropriate modification of the optical arrangement 14 may be required, as will be clear to one ordinarily skilled in the art.

The term "blackbody device" as used herein in the description and claims refers to a device for generating thermal radiation wherein the radiating surfaces are substantially enclosed within, or themselves define, a cavity, and wherein the radiation emanates from an aperture having an area significantly smaller than the surface area of the device. Although described in the context of a preferred implementation using such a "blackbody device", it should be appreciated that other devices simulating blackbody radiation, or other relatively small thermal targets, may also be used to implement the present invention.

The temperature range required for heated source 10 varies according to a number of parameters, and most predominantly, the intended effective temperature of the target and the ratio of magnification (enlargement) required to achieve the intended target size. In a typical case, the operating temperature range of the heated source lies in the range from ambient temperatures up to about 1000° C. For temperature differences of up to a few degrees, and for target sizes of up to about 1 meter, a smaller operating range of a few hundred degrees is typically sufficient.

As mentioned earlier, it is a particular feature of preferred implementations of the present invention that the projected thermal target may have larger dimensions than the projection region 12 of the heated source. Thus, the projection region 12 generally has a maximum dimension of not more than about 30 cm, and more typically between about 2 cm and 10 cm, whereas the targets projected typically have a maximum dimension from 50 cm up to several meters. It should be noted that the optical enlargement of the thermal image according to the present invention provides significant advantages of controllability. Specifically, it should be noted that temperature differences of one or more degrees Celsius at heated source 10 are mapped to differences of a fraction of a degree in the effective target temperature, thereby providing increases precision and stability of the effective target temperature.

In many cases, direct thermostatic control of heated source 10 is enough to control the target temperature. In some cases, it may be convenient to include a variable aperture 18 as part of optical arrangement 14 to allow immediate adjustment of an intensity of the thermal radiation incident on the target region. The provision of variable aperture 18 essentially reduces the target temperature adjustment which could take hours with a large conventional target to a matter of seconds, since the aperture adjustment instantaneously changes the intensity of radiation reaching surface 16 and hence the apparent temperature differential relative to the background. Variable aperture 18 is typically implemented as a standard diaphragm such as is common in optical cameras.

Optical arrangement 14 is implemented using optical components suited for the relevant wavelengths, preferably in the range of 3–5 μm or 8–14 μm, as is known in the art. In a simple implementation, a single convex lens can be used. In this case, variable magnification is preferably achieved by varying the spacing both from projection region 12 to the lens and from the lens to surface 16.

Optionally, in order to facilitate adjustment of the magnification without requiring repositioning of multiple elements, optical arrangement 12 may include an optical zoom (not shown). A further optional implementation of optical arrangement 12 employs a set of lenses or other optical elements (not shown) mounted so as to be selectively inserted into the optical path so that the various lenses, either alone or in different combinations, provide multiple levels of magnification.

Clearly, the aforementioned lens-based implementations may equally be implemented using mirror-based optics with suitable focusing mirror elements. Similarly, implementations based upon diffractive optical elements ("DOE's") may be used to advantage.

Most preferably, in order to ensure maximum efficiency and maximum uniformity, the optical arrangement and geometrical layout is arranged so as to focus the thermal radiation to effectively form an image of projection region 12 on surface 16.

Where the entirety of surface 16 corresponds to the intended target, optical arrangement 14 is configured to direct the thermal radiation onto the entirety of surface 16. For maximum uniformity of the thermal target, it is typically preferable that the thermal radiation is directed over a range of directions extending beyond the surface. By way of a parenthetical note, in order to facilitate the focusing procedure, it may be convenient to temporarily displace the optical arrangement out of alignment so that an edge of the thermal radiation pattern falls within the surface as viewed by a suitable sensor. For reasons of uniformity and efficiency, it is typically preferable that optical arrangement 14 be deployed with its optical axis falling roughly central within the target region of surface 16, and with its optical axis roughly perpendicular (e.g., at between about 70° and about 110°) to the target region surface. In most cases, it is also preferable that the optical arrangement 14 be positioned at a distance from surface 16 significantly greater than the maximum target region dimension $D_T$. Thus, the distance from optical arrangement 14 to surface 16 is preferably at least about five times $D_T$. This substantially avoids non-uniformity which could otherwise result from varying angles of incidence across surface 16.

In certain cases, it is desired to project a target onto only a part of the surface, or so as to have a particular shape, pattern or distribution. For such purposes, optical arrangement 14 is preferably supplemented by a mask (not shown) for defining a shape of the target region onto which the thermal radiation is projected. The mask may be a binary (occluding/transparent) mask, or may have multiple levels of transparency to achieve any desired target temperature pattern or distribution. In an implementation based on DOE's, the effect of a mask may be integrated with the required diffractive optical properties within a single DOE as is known in the art.

Turning now to surface 16, this is preferably configured to scatter a significant proportion of the thermal radiation to ensure non-directionality of the target. In other words, the surface preferably reflects primarily diffusely rather than specularly at least in the relevant range of wavelengths. Additionally, in order to minimize absorption of the thermal radiation by the surface and to minimize the contribution of the target body's own temperature to the target radiation, the surface is preferably chosen, or treated, to ensure an emissivity no greater than 0.5. For relatively small temperature differences between the thermal target and ambient temperatures, an emissivity around 0.5 or even greater is typically acceptable. For larger temperature differences, and to avoid bulk heating of the target material itself, lower emissivity of 0.2 or less is preferred.

One preferred technique for achieving the requirement of radiation scattering (i.e., minimal spectral reflection) while also minimizing the surface emissivity is by applying to the surface a coating (typically a paint) containing particles of a low emissivity material such as aluminum. In this case, the random orientations of the particles ensures scattering while the low emissivity of inherent to the material of the particles is largely maintained.

Although reflective target surfaces are typically preferred for their low cost and wear resistance, it should be noted that a transmissive target projection surface 16 also falls within the scope of the present invention. One non-limiting example of a suitable material for use as a transmissive scattering thermal target screen is amorphous silicon.

As mentioned earlier, it is sometimes desirable to generate certain features in the thermal target. One option mentioned earlier is the use of a mask or DOE to modify the thermal radiation illumination pattern. An alternative, or supplementary, option is to provide regions of surface 16 with modified optical properties in the relevant range of wavelengths. In one basic example of such an implementation, a pattern of light and dark bars such as is used in the "four-bar" sensor resolution test can be achieved simply by applying a set of spaced parallel strips of adhesive tape to surface 16, thereby increasing the emissivity/absorption of those regions.

Prior to initial use for a given configuration and spacing, the system is first set up as shown, a suitably calibrated thermal radiation sensor is directed towards the projected thermal target and either radiation source 10 or more preferably variable aperture 18 is adjusted until the required temperature differential between the target and the background is achieved. This is repeated for a range of different temperature differentials, thereby calibrating the target projection system for subsequent use. Optionally, by integrating with the calibrated sensor a suitable microprocessor-based controller and aperture-controlling actuator, this calibration procedure may be automated.

Additionally, or alternatively, by addition of a suitable microprocessor-based controller and aperture-controlling actuator, subsequent system operation can be automated so that the operator merely selects a desired temperature differential and the system generates the required settings.

EXAMPLE 1

Target requirements were defined as follows: 1 meter square target in the field at a range of 1 km from an imaging system to be tested. The target's apparent temperature should be controllable to generate an apparent temperature difference ($\Delta T$) between the target and the background of between 0° C. and 10° C. in steps of about 0.2° C. The $\Delta T$ should be uniform across the target and stable for at least a few minutes.

The components used were as follows:

- A 1 m×1 m plate painted with low emissivity (about 0.3) paint.
- A blackbody of 2.5 cm aperture diameter with a temperature range of 40° C.–1000° C.
- A lens with a focal length of about 140 mm and a diameter of about 135 mm in combination with a variable aperture.

The blackbody, the lens and the aperture were placed about 8 meters from the plate and the image of the blackbody's aperture was focused on the plate so as to form an image larger than the plate, thereby illuminating the plate uniformly. The blackbody was set to 800° C. and the variable aperture near the lens was used to vary the target's temperature.

The result was a target with easily controlled ΔT with resolution of better than 0.2° C., and temperature uniformity of about 0.1° C. RMS.

It will be appreciated that the above descriptions are intended only to serve as examples, and that many other embodiments are possible within the scope of the present invention as defined in the appended claims.

What is claimed is:

1. A method for generating a thermal target comprising:

(a) generating hot-body thermal radiation from a heated source, said thermal radiation emanating from a projection region having a first maximum dimension; and (b) employing an optical arrangement to project at least part of said thermal radiation onto a target region of a surface, said target region having a second maximum dimension greater than said first maximum dimension.

2. The method of claim 1, wherein said heated source is a blackbody device.

3. The method of claim 1, wherein said optical arrangement includes a variable aperture, the method further comprising adjusting the variable aperture so as to vary an apparent temperature of the projected target.

4. The method of claim 1, wherein said optical arrangement includes a mask for defining a shape of the target region onto which the thermal radiation is projected.

5. The method of claim 1, wherein said target region includes the entirety of the surface.

6. The method of claim 5, wherein said optical arrangement directs the thermal radiation over a range of directions extending beyond the surface.

7. The method of claim 1, wherein the surface has an emissivity of less than 0.2.

8. The method of claim 1, wherein the surface has an emissivity of less than 0.1.

9. The method of claim 1, wherein the surface provides a scattering effect for the thermal radiation.

10. The method of claim 1, wherein the surface is formed by a coating containing particles of material having emissivity less than 0.2.

11. The method of claim 1, wherein the surface is formed by a coating containing particles of aluminum.

12. The method of claim 1, wherein the second maximum dimension is at least half a meter.

13. The method of claim 12, wherein the first maximum dimension is no more than 30 centimeters.

14. A thermal target projection system comprising:

(a) a heated source for generating hot-body thermal radiation, said thermal radiation emanating from a projection region having a first maximum dimension;

(b) a surface; and (c) an optical arrangement deployed to project at least part of said thermal radiation onto a target region of said surface, said target region having a second maximum dimension greater than said first maximum dimension.

15. The system of claim 14, wherein said heated source is a blackbody device.

16. The system of claim 14, wherein said optical arrangement includes a variable aperture for adjusting an intensity of said thermal radiation incident on said target region.

17. The system of claim 14, wherein said optical arrangement includes a mask for defining a shape of said target region onto which said thermal radiation is projected.

18. The system of claim 14, wherein said optical arrangement is configured to direct said thermal radiation onto the entirety of said surface.

19. The system of claim 18, wherein said optical arrangement is configured to direct said thermal radiation over a range of directions extending beyond said surface.

20. The system of claim 14, wherein said surface has an emissivity of less than 0.2.

21. The system of claim 14, wherein said surface has an emissivity of less than 0.1.

22. The system of claim 14, wherein said surface is configured to scatter said thermal radiation.

23. The system of claim 14, wherein said surface is provided by a coating containing particles of material having emissivity less than 0.2.

24. The system of claim 14, wherein said surface is provided by a coating containing particles of aluminum.

25. The system of claim 14, wherein said second maximum dimension is at least half a meter.

26. The method of claim 25, wherein said first maximum dimension is no more than 30 centimeters.

* * * * *